US008231330B1

(12) United States Patent
Liang

(10) Patent No.: US 8,231,330 B1
(45) Date of Patent: Jul. 31, 2012

(54) TURBINE BLADE WITH FILM COOLING SLOTS

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 479 days.

(21) Appl. No.: 12/466,566

(22) Filed: May 15, 2009

(51) Int. Cl.
*B63H 1/14* (2006.01)

(52) U.S. Cl. ..... 415/115; 416/232; 416/241 B; 416/241 R

(58) Field of Classification Search ..... 415/115, 415/116; 416/96 A, 96 R, 97 R, 232, 241 R
See application file for complete search history.

(56) References Cited

U.S. PATENT DOCUMENTS 3,781,129 A * 12/1973 Aspinwall ..... 416/97 R
4,940,388 A * 7/1990 Lilleker et al. ..... 416/97 R
5,096,379 A * 3/1992 Stroud et al. ..... 416/97 R
5,356,265 A * 10/1994 Kercher ..... 416/97 R
5,846,057 A * 12/1998 Ferrigno et al. ..... 416/241 R
6,494,678 B1 * 12/2002 Bunker ..... 416/97 R
6,514,037 B1 * 2/2003 Danowski et al. ..... 415/115
7,021,896 B2 * 4/2006 Dodd ..... 416/97 R
7,249,934 B2 * 7/2007 Palmer et al. ..... 416/97 R
2002/0182074 A1 * 12/2002 Bunker ..... 416/97 R
2007/0286729 A1 * 12/2007 Kopmels ..... 416/97 R
2009/0081048 A1 * 3/2009 Beeck et al. ..... 416/97 R
2009/0180861 A1 * 7/2009 Trindade et al. ..... 415/115

* cited by examiner

*Primary Examiner* — Michael Lebentritt
(74) *Attorney, Agent, or Firm* — John Ryznic

(57) ABSTRACT

A turbine rotor blade with a row of exit slots adjacent to a trailing edge region of the airfoil that extends from the platform to the blade tip, where the row of exit slots is formed into three groups that include an upper span group, a mid-span group and a lower span group. The upper span group discharges film cooling air upward with respect to the airfoil chordwise direction, the mid-span group discharges along the chordwise direction, and the lower span group discharges in a direction downward with respect to the chordwise direction. Each exit slot is formed with a plurality of metering inlet holes that discharge into a first diffusion section and then a second diffusion section.

8 Claims, 3 Drawing Sheets

TURBINE BLADE WITH FILM COOLING SLOTS

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with film cooling slots.

2. Description of the Related Art Including Information Disclosed Under 37 CFR 1.97 and 1.98

A gas turbine engine, such as an industrial gas turbine (IGT) engine, includes a turbine with multiple rows or stages or stator vanes that guide a high temperature gas flow through adjacent rotors of rotor blades to produce mechanical power and drive a bypass fan, in the case of an aero engine, or an electric generator, in the case of an IGT. In both cases, the turbine is also used to drive the compressor.

It is well known in the art of gas turbine engine design that the efficiency of the engine can be increased by passing a higher gas flow temperature through the turbine. However, the turbine inlet temperature is limited by the material properties of the turbine, especially for the first stage airfoils since these are exposed to the highest temperature gas flow. As the gas flow passes through the various stages of the turbine, the temperature decreases as the energy is extracted by the rotor blades.

Another method of increases the turbine inlet temperature is to provide more effective cooling of the airfoils. Complex internal and external cooling circuits or designs have been proposed using a combination of internal convection and impingement cooling along with external film cooling to transfer heat away from the metal and form a layer of protective air to limit thermal heat transfer to the metal airfoil surface. However, since the pressurized air used for the airfoil cooling is bled off from the compressor, this bleed off air decreases the efficiency of the engine because the work required to compress the air is not used for power production. It is therefore wasted energy as far as producing useful work in the turbine.

Shaped diffusion film cooling holes are normally used for the cooling of a turbine blade pressure side wall. The use of axial oriented film cooling holes on the pressure side surface of the airfoil is mainly for an injection of cooling air inline with the main stream gas flow which is accelerated into multiple directions as represented by the various arrows in FIG. 1.

However, at the airfoil pressure side surface two thirds of the way downstream from the leading edge region, the hot gas secondary flow migrates in the multiple directions, depending on the pressure gradient and also moving in an axial direction. Due to pressure gradient across the blade tip, the upper blade span hot gas flow migrates toward the blade tip section. Due to the nature of turbine expansion, the middle portion flow in the axial direction. Due to the hot gas passage channel pressure gradient, the lower span hot gas flow migrates toward the blade platform. An axial oriented shaped film cooling hole is used in that region of the blade thus becomes undesirable. FIG. 1 shows the secondary hot gas flow phenomena on the blade pressure side surface.

BRIEF SUMMARY OF THE INVENTION

It is an object of the present invention to provide for a turbine rotor blade with a film cooling slot arrangement that will reduce the migration of hot gas flow toward the blade tip over that of the cited prior art blades.

It is another object of the present invention to provide for a turbine rotor blade with an improved blade tip cooling design so that the blade life is increased over that of the cited prior art blades.

These objectives and more can be achieved by the turbine rotor blade of the present invention that includes a row of film cooling slots located on the pressure side wall and adjacent to a trailing edge region of the airfoil in which the slots are multiple compound angled multi-diffusion film cooling slots at a special spanwise angle relative to the airfoil. The slots are formed into three equal groups in the row and include an lower span group with a discharge angle oriented downward from a hot gas flow direction, a mid-span group with a discharge angle oriented parallel to the hot gas flow path, and an upper spanwise group with a discharge angle oriented upward from the hot gas flow path.

Each slot includes multiple metering holes that open into a first diffusion chamber and then into a second diffusion chamber before discharging out from the slot opening. With this design, the compound angled multi-diffusion film cooling slots allow the cooling air flow to discharge from each individual metering hole to be injected onto the airfoil surface at a certain spanwise angle and to be diffused within the diffuser. This yields a good buildup of the coolant sub-boundary layer next to the airfoil pressure side surface to form a film layer without shear mixing effect to seal the airfoil fro the hot gas flow.

DETAILED DESCRIPTION OF THE INVENTION

Figure 1:
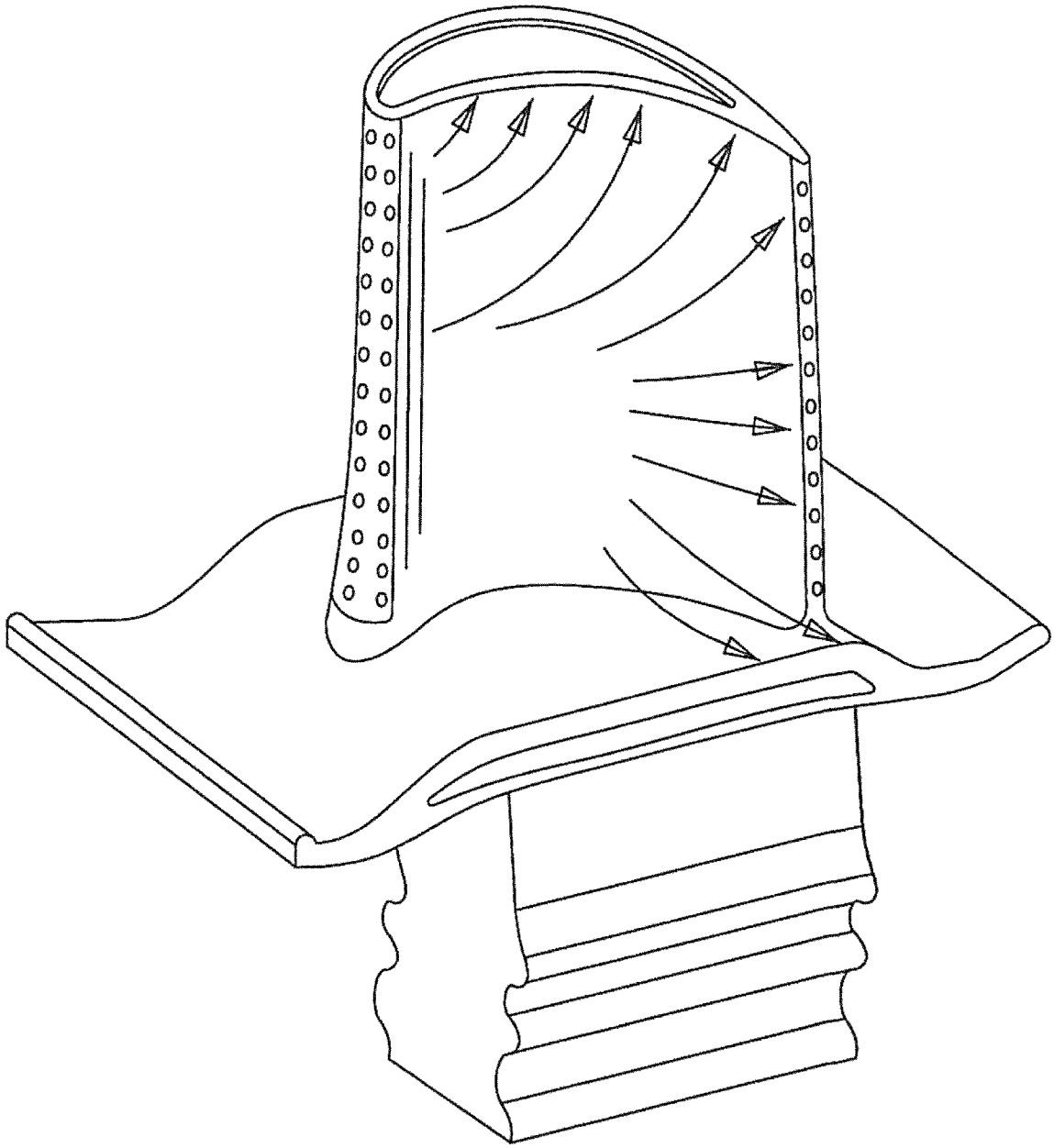
Fig 1 Prior Art
FIG. 1 shows a prior art turbine blade with the secondary hot gas flow migration on the pressure side wall toward the blade tip.
Figure 2:
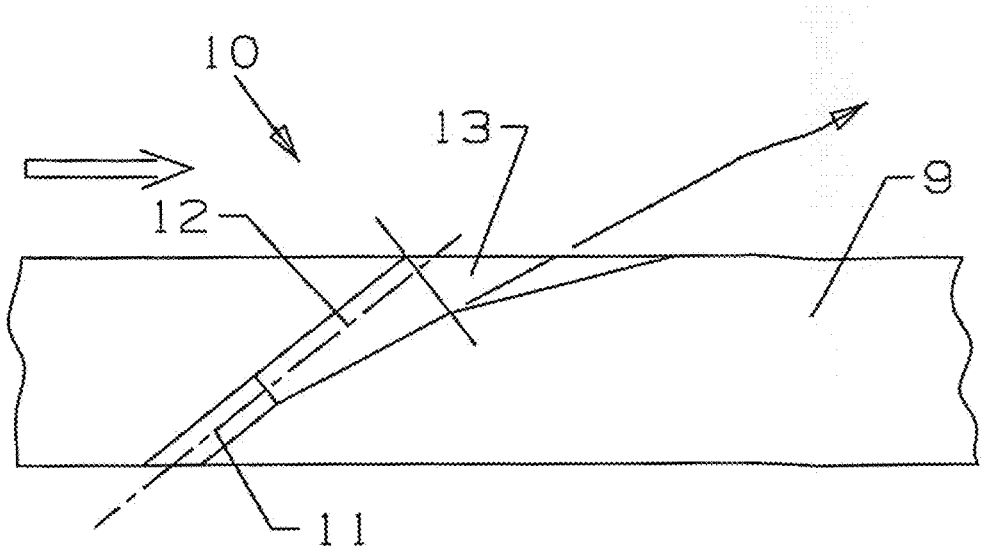
FIG. 2 shows a cross section view of one of the compound angled multi-diffusion film cooling slots of the present invention.

The present invention is a turbine rotor blade with a row of film cooling slots located adjacent to the trailing edge region of the blade to reduce or eliminate the prior art hot gas flow migration problem described above in the prior art toward the blade tip. The blade of the present invention is intended for use in an industrial gas turbine engine, but can be adapted for use in an aero engine. FIG. 2 shows a cross section side view of one of the compound angled multi-diffusion film cooling slots 10 used on the blade of the present invention. The slot 10 includes a metering inlet section 11 of a constant diameter, a first expansion section located immediately downstream from the metering section 11, and a second expansion section 13 located immediately downstream from the first expansion section 12. The first expansion section includes a downstream wall with an expansion of from 7 to 13 degrees with respect to the axis of the metering hole in the metering section 11. The second expansion section 13 includes a downstream wall with an additional expansion of 7 to 13 degrees with respect to the downstream wall in the first expansion section 12. The second diffusion section 13 opens onto the outer airfoil surface of the airfoil wall 9.

Figure 3:
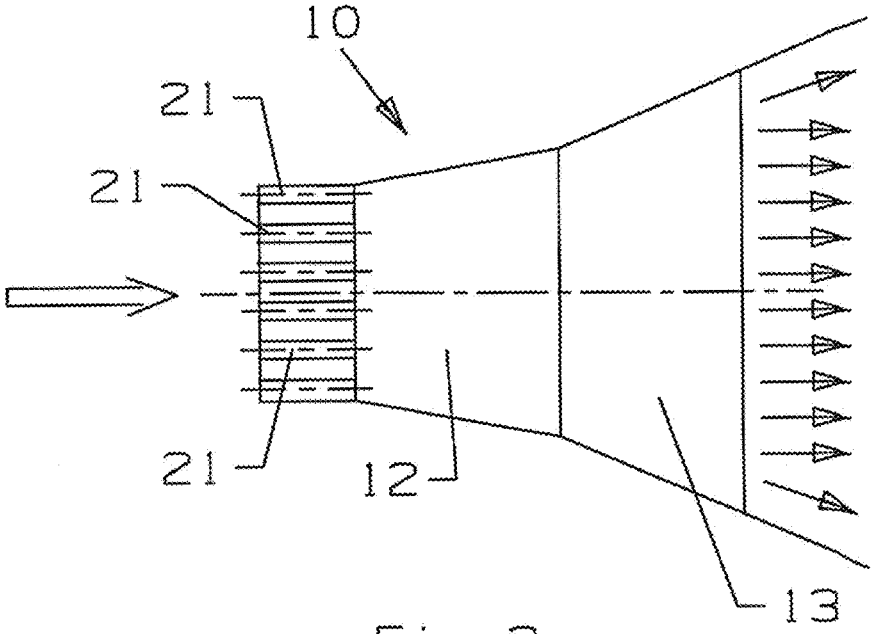
FIG. 3 shows a top view of the compound angled multi-diffusion film cooling slots of the present invention in FIG. 2.

FIG. 3 shows a top view of the slot 10 of FIG. 2 with a number of metering holes 21 each of a constant diameter that forms the metering section 11 of the slot 10. In the various embodiments, the number of metering holes for each slot can be from 3 to 5 or 6. The first expansion section 12 also includes two side walls that have an expansion each of the side walls but vary in the expansion angle depepending upon the location of the slot within the three zones or groups. The second expansion section also includes two side walls with an expansion that varies depending upon which group the slot is in.

Figure 4:
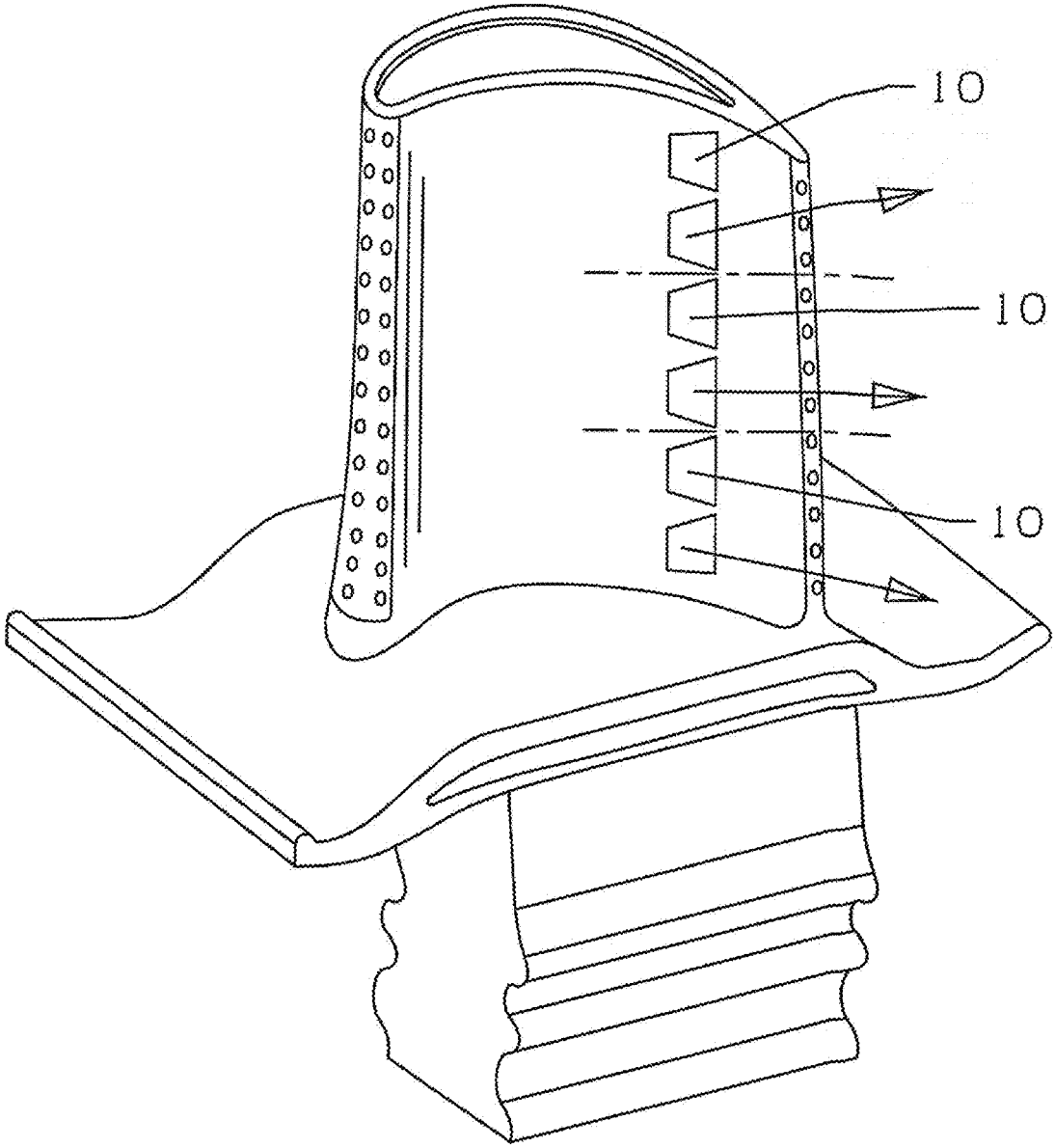
FIG. 4 shows a turbine rotor blade with a row of the compound angled multi-diffusion film cooling slots of the present invention.

FIG. 4 shows the blade with a row of 6 slots being divided up into a lower span group nearest to the platform, a middle span group and an upper span group nearest to the blade tip. Each of the three groups takes up around one third of the spanwise distance of the airfoil so that they form equal spanwise length groups to cover the three spanwise sections of the airfoil.

Each of the three slot groups is oriented at a different spanwise angle relative to the blade. The lower span group is at 110 to 130 degrees spanwise angle and located in the lower one third of the spanwise length of the airfoil. The mid-span group is oriented at 80 to 100 degrees spanwise angle and located in the middle one third of the spanwise length of the airfoil. The upper span group is at 20 to 40 degrees from the spanwise angle and is located in the upper one third of the spanwise length of the airfoil. All of the slots can be formed by EDM or laser drilling the two diffusion sections onto the airfoil pressure side wall followed by drilling the multi-metering holes into each individual diffusion slot. The spanwise angle is the angle defined between the blade radial span direction to the centerline of the film cooling hole in a clockwise rotation direction. A line parallel to the airfoil spanwise (radial) direction will be at zero degrees while the direction parallel to the chordwise direction of the airfoil (and in an aft direction) will be at 90 degrees.

The main purpose of the compound angled multi-diffusion film cooling slots is to allow the cooling flow discharged from each individual metering hole to be ejected onto the airfoil surface at a specific spanwise angle and diffused within the diffuser. This yields a good buildup of the coolant sub-boundary layer next to the airfoil pressure side surface and forms a layer of film cooling air without the shear mixing effect in order to better seal the airfoil wall from the hot gas flow.

Each of the slots is formed of two main portions: a first portion for the metering holes which are at a constant diameter. These metering holes are drilled at the same orientation as the compound angled multi-diffusion film cooling slot. The second portion is the multi-diffusion slot which is shaped depending upon which spanwise group it is in. the upper span group of slots 10 is formed with a 0-3 degree expansion in the spanwise radial outward direction (top wall surface as seen in FIG. 4). The multiple expansion concept is incorporated in the spanwise radial direction, a 7-13 degree first expansion from the end of the metering hole to the diffuser exit plane followed by a second expansion of 7-13 degree from the diffuser exit plane to the airfoil exterior surface. All of these expansion angles are relative to the centerline of the metering hole.

In the mid-span group, the multi-diffusion slot is formed with a 7-13 degree expansion in the spanwise radial outward and inboard directions for the first expansion. Thus, both the top wall and the bottom wall as seen in FIG. 4 for the slot expands from 7-13 degrees. The second expansion is 7-13 degrees from the diffuser exit plane to the airfoil exterior surface. All of these expansion angles are relative to the centerline of the metering hole. All of the diffusion angles are relative to the centerline of the metering hole.

The lower span group includes a 0-3 degrees expansion in the spanwise radial inboard direction (the bottom wall as seen in FIG. 4). The multiple expansion concept is incorporated into the spanwise radial outward direction with a 7-13 degree first expansion from the end of the metering hole to the diffuser exit plane flowed by a second expansion of 7-13 degrees from the diffuser exit plane to the airfoil exterior surface. The lower span slots are a mirror image of the upper span slots.

Thus, the upper span slots discharge in a direction in the range of 20-40 degrees from the radial spanwise direction of the airfoil, preferably at around 30 degrees; the mid-span slots discharge in the range of 80-100 degrees from the radial spanwise direction of the airfoil, preferably at around 90 degrees; and the lower span slots discharge in a direction in the range of 110-130 degrees from the radial spanwise direction of the airfoil, preferably at around 120 degrees.

I claim the following:

1. An air cooled turbine rotor blade comprising:
an airfoil having a leading edge and a trailing edge;
the airfoil having a pressure side wall and a suction side wall both extending between the leading edge and the trailing edge;
a row of exit slots arranged along the pressure side wall of the airfoil adjacent to the trailing edge region of the airfoil;
the row of exit slots extending from adjacent to a platform of the blade to adjacent to a tip of the blade;
the row of exit slots including an upper span section of slots, a mid-span section of slots and a lower span section of slot; and,
the upper span exit slots discharging film cooling air in a direction toward the blade tip, the mid-span exit slots discharging film cooling air in a chordwise direction of the airfoil, and the lower span exit slots discharging film cooling air in a direction toward the platform.

2. The air cooled turbine rotor blade of claim 1, and further comprising:
the exit slots each include a metering inlet section with a plurality of metering holes that open into a diffusion section.

3. The air cooled turbine rotor blade of claim 2, and further comprising:
the diffusion section includes a first diffusion section immediately downstream from the metering section and a second diffusion section immediately downstream from the first diffusion section.

4. The air cooled turbine rotor blade of claim 3, and further comprising:
the first diffusion section includes an expansion of from 7 to 13 degrees on a downstream wall with respect to an axis of the metering holes.

5. The air cooled turbine rotor blade of claim 4, and further comprising:

the upper span exit slots have a radial outboard expansion of 0 to 3 degrees and a radial inboard expansion of from 7 to 13 degrees; and, the mid-span exit slots have a radial outboard expansion of 7 to 13 and a radial inboard expansion of from 7 to 13 degrees; and, the lower-span exit slots have a radial outboard expansion of 7 to 13 and a radial inboard expansion of from 0 to 3 degrees.

6. The air cooled turbine rotor blade of claim 1, and further comprising:

the upper span exit slots have a radial outboard expansion of 0 to 3 degrees and a radial inboard expansion of from 7 to 13 degrees; and, the mid-span exit slots have a radial outboard expansion of 7 to 13 and a radial inboard expansion of from 7 to 13 degrees; and, the lower-span exit slots have a radial outboard expansion of 7 to 13 and a radial inboard expansion of from 0 to 3 degrees.

7. The air cooled turbine rotor blade of claim 1, and further comprising:

the upper span exit slots have a discharge angle with respect to the airfoil spanwise radial direction of from 20 to 40 degrees;

the mid-chord span exit slots have a discharge angle with respect to the airfoil spanwise radial direction of from 80 to 100 degrees; and, the lower span exit slots have a discharge angle with respect to the airfoil spanwise radial direction of from 110 to 130 degrees.

8. The air cooled turbine rotor blade of claim 1, and further comprising:

the upper span exit slots have a discharge angle with respect to the airfoil spanwise radial direction of around 30 degrees;

the mid-chord span exit slots have a discharge angle with respect to the airfoil spanwise radial direction of around 90 degrees; and, the lower span exit slots have a discharge angle with respect to the airfoil spanwise radial direction of around 120 degrees.

* * * * *